United States Patent [19]

Stone

[11] 4,162,621

[45] Jul. 31, 1979

[54] BASKET OVERFLOW FOR WATER RECIRCULATING CLOTHES WASHING MACHINE

[75] Inventor: Aidan M. Stone, Louisville, Ky.

[73] Assignee: General Electric Company, Louisville, Ky.

[21] Appl. No.: 896,874

[22] Filed: Apr. 17, 1978

[51] Int. Cl.[2] ..... D06F 13/02; D06F 23/04; D06F 37/00

[52] U.S. Cl. ..... 68/23.2; 68/53; 68/208

[58] Field of Search ..... 68/23.2, 23.5, 23.6, 68/23.7, 53, 131, 133, 184, 208

[56] References Cited

U.S. PATENT DOCUMENTS

| | | | |
|---|---|---|---|
| 2,421,803 | 6/1947 | Neal | 68/23.5 |
| 2,538,246 | 1/1951 | Holm-Hansen | 68/23.2 X |
| 3,494,152 | 2/1970 | Pick | 68/23.7 X |

FOREIGN PATENT DOCUMENTS

| | | | |
|---|---|---|---|
| 867840 | 2/1953 | Fed. Rep. of Germany | 68/133 |

*Primary Examiner*—Philip R. Coe

*Attorney, Agent, or Firm*—Bruce A. Yungman; Radford M. Reams

[57] ABSTRACT

A clothes washing machine having water recirculation from the tub into the clothes holding basket, with a series of overflow openings located about the periphery of the upper region of the basket at a point below the basket balancing ring. The maximum water level is established above the overflow openings even with the balancing ring by a gutter ring secured to the exterior of the basket defining a trough accepting the water from the overflow openings. The outer wall of the gutter ring extends upwardly from the level of the overflow openings and has an upper edge at the level at which the basket water level is established.

5 Claims, 3 Drawing Figures

BASKET OVERFLOW FOR WATER RECIRCULATING CLOTHES WASHING MACHINE

BACKGROUND DISCUSSION

This invention concerns vertical axis clothes washing machines and more particularly washing machines of the type having an inner clothes receiving basket and an outer tub surrounding the backet which collects the water from the basket during extract/spin cycles.

In typical designs of such washing machines, the basket is perforated to allow escape of the water and the perforations allow unlimited flow of water from the basket into the surrounding tub. The wash and rinse water occupies both the tub and basket during the wash and rinse cycles at the same level.

In an effort to reduce the volume of water required for a given load of clothes, some clothes washer designs have incorporated water saving circulation systems, in which water is pumped from the tub into the basket during the wash and rinse cycles to reduce the level of water present in the washer tub to thereby save this volume of water. The water in the space between the tub and the basket wall, not contributing to the washing action, may be eliminated without compromising the effectiveness of the wash or rinse cycles.

In such recirculation systems, the flow of water from the basket into the surrounding tub is controlled to be at a rate less than the capacity of the recirculation pump, such that the recirculation pump may reduce the level of water in the tub below that existing in the basket. This controlled flow is generally produced by a limited number of perforations located in the basket bottom.

In such an arrangement, an overflow is required in order to establish the maximum water level in the basket for maximum loads, as may be provided by a series of overflow openings extending about the upper periphery of the basket. These overflow openings also act to allow the water to pass out of the basket into the tub during the extract/spin cycles. The overflow openings allow flow from the basket into the tub at a rate when combined with the flow through bottom openings greater than the recirculation pump capacity such that the basket water level cannot exceed the level at which the overflow openings are located.

Many such washing machines also include balancing rings in which an annular cavity formed in the upper section of the basket is filled with a heavy granular material such as magnetite, which acts to balance the basket during high speed rotation in the spin cycle.

It may be desirable to establish the maximum water level in the basket at a point aligned with the balancer ring. The presence of the balancer ring makes it impractical to locate the overflow openings at this level. It would add considerably to the manufacturing expense of the basket if an existing basket design were to be revised in order to implement such a recirculation system. It would also be advantageous if such an arrangement could be added to an existing basket configuration.

Accordingly, it is an object of the present invention to provide a water-level establishing basket overflow arrangement for such recirculation clothes washing machines which allows the water level to be established above the level at which the basket overflow openings are located such that the water level in the basket can be established at a point where the balancer ring is located.

It is a further object of the present invention to provide such an overflow arrangement which is readily adapted to existing basket designs without requiring modification of the basket designs in order to incorporate the overflow arrangement.

SUMMARY OF THE INVENTION

These and other objects of the present invention, which will become apparent upon a reading of the following specification and claims, are accomplished by providing a gutter ring secured to the exterior of the basket and which together with the outside surface of the basket define a water receiving trough, which trough is aligned with a series of overflow openings or perforations formed about the periphery of the basket. The upper edge of the gutter ring is located at a point above the overflow openings whereat the water level is established. The water flows out through the overflow openings filling the trough and overflowing at the upper edge of the ring, the basket water level rising to the same level as the upper edge of the gutter ring at which the basket balancer ring is located. The gutter ring is formed of a molded or extruded plastic, secured to the basket by a wire ring.

DETAILED DESCRIPTION

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
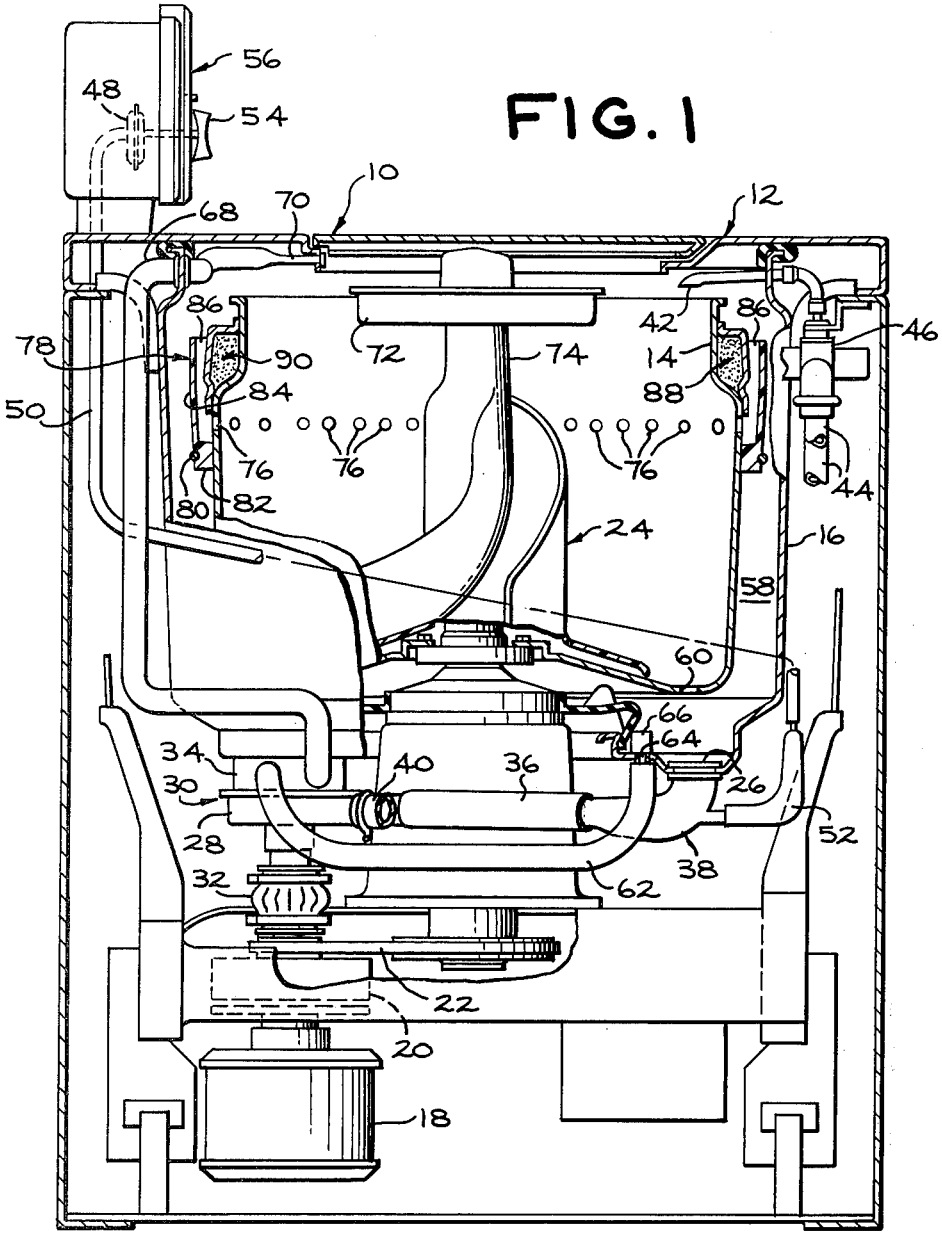
FIG. 1 is a side elevational view of a clothes washing machine with a portion of the external cabinetry broken away and certain of the components shown in partial section.

Referring to the drawings and particularly to FIG. 1, the clothes washing machine 10 includes an outer cabinet 12 within which are mounted the various functional components, including a generally cylindrical clothes receiving basket 14 and vertically disposed within the interior of the tub 16. The basket 14 is adapted to be spun by an electric motor 18 acting through a two-speed clutch 20 and a belt drive 22, which also serves to drive a transmission 21 which oscillates the agitator 24 during wash and rinse cycles, to provide a means for washing and rinsing the clothes and thereafter removing the wash and rinse water from the basket 14.

As per conventional clothes washing machine design, the clothes receiving basket 14 is adapted to contain the clothes during the wash and rinse cycles, and the water disposed therein extracted during a spinning of the basket 14 to cause the water to pass out into the tub 16 where it is collected.

Tub 16 is provided with a drain 26 which receives the basket overflow during the spin cycle with the drain water pumped into the plumbing drain by means of a drain pump deck 28. The drain pump deck 28 is part of a two-deck stacked pump assembly 30, driven via flexible coupling 32 by the same electric motor 18 as drives the agitator 24 and basket 14.

Stacked pump assembly 30 includes the drain pump deck 28 and also a recirculation pump deck 34. The drain pump deck 28 has its impeller oriented such that during rotation of the electric motor 18 during spin of the basket 14, pumping action is created by the impeller, tending to pump water from an inlet connected to a hose 36, in turn secured to the drain fitting 38. The outlet 40 is directed to the external drain via a hose (not shown).

The particular clothes washing machine design depicted in FIG. 1 is intended to conserve water by reducing the level of water in the tub 16 during the wash and rinse cycles.

The basket 14 and tub 16 are initially filled at the start of each wash and rinse cycle via a fill spout 42 which receives water from supply lines 44 and a solenoid-operated fill valve 46. The fill valve 46 allows the flow of water under the control of pressure-sensitive switch 48, which senses the pressure head of the water in the tub 16 via a tube connection 50 with an air chamber 52 in fluid communication with the tub 16 via a connection with the drain fitting 38. The pressure-sensitive switch 48 is adjustable so as to be activated at a predetermined pressure level by a control knob 54 included on the machine control panel 56.

The arrangement operates in a well-known manner to adjust the particular pressure level at which the pressure-sensitive switch 48 is activated causing the solenoid-operated fill valve 46 to discontinue water flow when a predetermined level of water has been reached corresponding to the pressure head activating the pressure-sensitive switch 48.

In many clothes washing machine designs, the basket 14 is generally perforate such that the water level in the basket 14 is the same as in the tub 16. However, in the design depicted in FIG. 1, a recirculation system is incorporated to reduce the level of water in the tub 16 after the tub and basket water fill, in order to reduce the volume of water required to carry out a wash or rinse cycle. This recirculation involves pumping of the water in the space 58 into the basket 14 during the wash and rinse cycles. The flow of water out of the basket 14 is controlled by providing a series of bottom-located perforations or openings 60 in the basket 14. Apportioning of inlet flow through fill spout 42 between the basket 14 and the tub 16 and flow through the openings 60 insures equal levels in the basket 14 and the tub 16 during fill, but the volume of water flow from the basket 14 into the tub 16 is controlled by the size and number of bottom-located perforations 60.

Recirculation flow is produced by the recirculation pump deck 34 of the pump assembly 30 with the inlet of the recirculation pump deck 34 connected via a hose 62 with a recirculation intake opening 64 and a stand pipe provided for the purpose described in copending application, Ser. No. 906,515, filed May 17, 1978.

Recirculation pump deck 34 operates to create a pumping action by drive of the electric motor 18 whenever the oscillation of agitator 24 is taking place. In this drive condition, the electric motor 18 is rotating in the opposite direction from that in which it rotates during spin of the basket 14, such that a continuous pumping action takes place during the wash and rinse cycles in which water is pumped out of the space 58 intermediate the basket 14 and tub 16.

The outlet of the recirculation pump deck 34 is connected to a recirculation hose 68 which directs the recirculated water into a nozzle 70 directing the recirculation flow into the interior of the basket 14, after having passed through a lint tray 72 mounted to the agitator post 74.

The capacity of the recirculation pump deck 34 is greater than the flow from the basket 14 into the tub 16 interior via the openings 60 such that the level of water in the tub 16 is ordinarily substantially below the level of water in the basket 14 to thereby achieve the water saving end sought by this design.

In this type of system, in order to establish the maximum water level in the clothes basket, a series of overflow openings are normally provided at the level of the basket corresponding to the maximum water level. These overflow openings also act to allow extract water flow out of the basket during the spin cycle. Upon reaching this level, the flow through these openings creates a rate of escape of the water from the basket in excess of the capacity of the circulation pump, such that the water level cannot rise above the level.

In many washing machines, as here, the basket 14 is provided with a balancing ring 88. The balancing ring 88 has an annular pocket 90 filled with a granular material such as magnetite which serves to balance the basket 14 during rotation. It can be appreciated that the overflow openings cannot be conveniently located at this level. This could require redesign of the basket 14 if the maximum water level is required to be established at the level of the basket for proper washing action.

Accordingly, in order to establish the level of water in the tub 16, a series of overflow perforations or openings 76 are formed extending above the periphery of the basket 14 at a height on the basket 14 below the maximum water level. A gutter ring 78 is secured to the outer periphery of the tub 14 as by means of a retaining ring 80 which exerts a compressive pressure on an annular flange 82 formed on the gutter ring 78, extending radially inward to be slidably fit over the outside surface of the basket 14.

The outer wall 84 of the gutter ring 78, together with the outside surface of the basket 14, defines a trough 86 which is located to receive the water flowing through the overflow openings 76. The outer wall 84 extends upwardly from the level of the overflow openings 76 with the upper edge in approximate alignment with the balancing ring 88.

Figure 3:
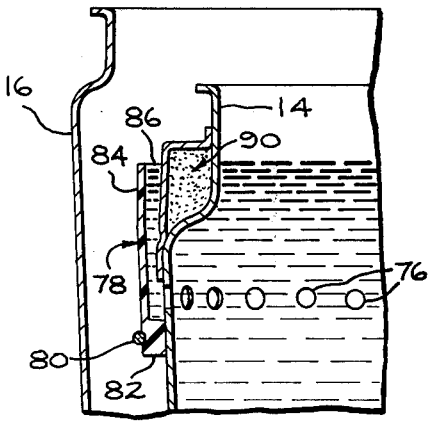
FIG. 3 is a sectional view of the basket portion shown in FIG. 2 depicting the maximum water level established in the basket by overflow over the top edge of the gutter ring.
Figure 2:
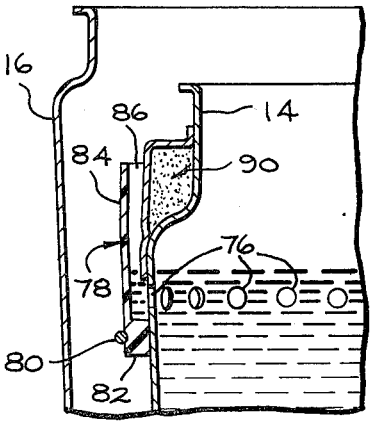
FIG. 2 is an enlarged sectional view of a portion of the washing machine basket shown in FIG. 1, depicting the water flow into the gutter ring.

Thus, the water passes through the overflow openings 76 upon rising to this level into trough 86 (FIG. 2) and the level in the basket 14 continues to rise as the recirculation flow continues, until the water level in the trough 86 has reached the top edge of the outer wall 84 (FIG. 3). At this point, the water passes over the upper edge and into the interior of the tub 16. The water flow volume over the upper edge, taken together with the flow from the bottom-located openings 60, exceeds the capacity of the recirculation pump deck 34 which therefore cannot pump a sufficient volume of water out of the space 58 to equal this combined flow. The water level in the basket 14 is thereby stabilized at this level which thereby establishes the maximum water level in the basket 14. As noted, the point on the basket at which it is established is aligned with the balancing ring 88 and thus the use of the gutter ring 78 has enabled the water level in the basket 14 to be established even with the balancing ring 88.

The gutter ring 78 may simply be added to an existing basket design to avoid the necessity of a redesign of the basket and the consequent retooling costs. The gutter ring itself may be formed of a low-cost plastic material retained by the simple retaining ring 80 and would be relatively inexpensive to manufacture.

Many variations in the specific configuration of the various components, such as that of the gutter ring, may of course be possible while still achieving the end result of the present invention.

The embodiments of the invention in which an exclusive property or privilege is claimed are defined as follows:

1. In a clothes washing machine including:

a tub;

a generally cylindrical clothes receiving basket mounted within said tub, said basket being formed with a series of openings in the bottom thereof;

means for washing and rinsing clothes disposed in said basket and removing water from said basket after said washing and rinsing;

recirculation pump means causing water entering said tub through said basket openings to be recirculated into said basket at a faster rate than water flow into said tub through said bottom openings in said basket during said washing and rinsing;

whereby said level of water in said tub is reduced below the level of said water in said basket during said washing and rinsing;

a series of overflow openings formed about the periphery of said basket at a level vertically spaced above said bottom basket openings;

a gutter ring secured to the exterior of said basket extending about said basket periphery at a level substantially aligned with said overflow openings in said basket;

said gutter ring defining a trough extending about said basket and in fluid communication with said overflow openings;

said gutter ring including an upper edge extending vertically above the level of said overflow openings, whereby water flow enters said trough and rises to said upper edge of said gutter ring prior to overflow into said tub;

whereby the water level in said basket will rise to the level of said upper edge of said gutter ring.

2. The clothes washing machine according to claim 1 wherein said recirculating pump means capacity is less than the combined flow through said bottom basket openings and said overflow openings, whereby said recirculation pump means cannot increase the level in said basket above the level of said gutter ring upper edge.

3. The clothes washing machine according to claim 2 wherein said basket is provided with a balancing ring located above the level of said basket bottom openings and substantially aligned with said trough in said gutter ring, whereby said maximum water level in said basket is established substantially at the level of said balancing ring.

4. The clothes washing machine according to claim 1 wherein said gutter ring includes a radially inwardly extending flange portion in engagement with said basket exterior below the level of said series of overflow openings.

5. The clothes washing machine according to claim 4 further including a wire ring secured to the outside diameter of said gutter ring over said inwardly extending flange and compressing said flange into frictional engagement with said basket exterior surface, whereby said gutter ring is mounted to said basket by said wire ring.

* * * * *